US007419118B1

(12) United States Patent
Cooper et al.

(10) Patent No.: US 7,419,118 B1
(45) Date of Patent: Sep. 2, 2008

(54) ROLLED SHEET PRODUCT DISPENSER

(75) Inventors: Kerry John Cooper, Pleasantville, NY (US); George Calvin Scott, New Fairfield, CT (US)

(73) Assignee: Polder, Inc., Port Chester, NY (US)

( * ) Notice: Subject to any disclaimer, the term of this patent is extended or adjusted under 35 U.S.C. 154(b) by 0 days.

(21) Appl. No.: 11/684,432

(22) Filed: Mar. 9, 2007

(51) Int. Cl.
*B65H 16/04* (2006.01)

(52) U.S. Cl. ..... 242/597.7

(58) Field of Classification Search ..... 242/597.7, 242/597.8, 597, 597.5, 597.1, 597.2, 597.4, 242/597.6, 591
See application file for complete search history.

(56) References Cited

U.S. PATENT DOCUMENTS

| | | | | | |
|---|---|---|---|---|---|
| 634,000 | A | * | 10/1899 | Hromas | 242/597.7 |
| 1,070,641 | A | * | 8/1913 | Walker | 242/597.8 |
| 1,354,369 | A | * | 9/1920 | Anderson | 242/597.5 |
| D101,815 | S | * | 11/1936 | Kivley | 242/597.7 |
| 2,554,812 | A | * | 5/1951 | Buckman | 242/597.7 |
| 3,294,352 | A | | 12/1966 | Thomas | |
| 3,656,700 | A | * | 4/1972 | Gauvin | 242/597.7 |
| 3,806,057 | A | | 4/1974 | Whatley | |
| 4,726,179 | A | * | 2/1988 | Smith et al. | 242/597.6 |
| 5,799,895 | A | | 9/1998 | Michaud et al. | |
| 6,161,796 | A | | 12/2000 | Daniels | |
| 6,302,348 | B1 | | 10/2001 | Lillelund et al. | |
| 6,467,717 | B1 | | 10/2002 | Pedicano et al. | |
| 6,793,097 | B2 | * | 9/2004 | Kamenstein | 242/597.7 |
| D520,278 | S | | 5/2006 | Mariano et al. | |
| 7,104,418 | B2 | | 9/2006 | Kamenstein | |
| 7,140,573 | B1 | | 11/2006 | Jerstroem et al. | |
| 2005/0184190 | A1 | * | 8/2005 | King et al. | 242/597.8 |
| 2006/0071119 | A1 | | 4/2006 | Zeitlin | |
| 2006/0219837 | A1 | | 10/2006 | Yang et al. | |
| 2006/0266876 | A1 | | 11/2006 | Yang et al. | |
| 2006/0284001 | A1 | | 12/2006 | Paradise et al. | |

FOREIGN PATENT DOCUMENTS

| | | |
|---|---|---|
| WO | WO 2005/073107 | 8/2005 |

* cited by examiner

*Primary Examiner*—William A Rivera
(74) *Attorney, Agent, or Firm*—Baker & McKenzie LLP

(57) ABSTRACT

A rolled sheet product dispenser, including a base and a shaft oriented coaxially with the base. The shaft has a first end and a second end, with the first end being attached to the base. A bracket includes at least one mounting surface, and a base engagement element is attached to the base, the base engagement element being operable for detachable engagement with the bracket. The bracket is operable to position the shaft horizontally when the base engagement element is engaged with the bracket, and the shaft is dimensioned to allow insertion of the shaft within a roll of a rolled sheet product.

22 Claims, 6 Drawing Sheets

ROLLED SHEET PRODUCT DISPENSER

FIELD

The present application relates to apparatuses and methods for storing and dispensing rolled sheet products, and in particular to apparatuses and methods for securely and conveniently storing and dispensing rolled sheet products in either of a horizontal and a vertical orientation.

BACKGROUND

Several devices have been proposed for storing and dispensing rolled sheet products, for instance paper or plastic sheet product packaged by rolling the paper or plastic sheet product around a central hollow core roll. However, such dispensing devices typically only secure the rolled sheet product in one of a vertical or a horizontal orientation. Such a limitation restricts the utility and portability of the device. Furthermore, conventional rolled sheet product dispensing devices secured to a wall or other surface require that a user locate themselves near the dispenser to operate the dispenser and obtain rolled sheet products.

Therefore there is a need for a rolled sheet product dispensing device that allows storing and dispensing of the rolled sheet product in both a horizontal and vertical orientation, and that is conveniently and easily adjusted between a horizontal orientation and a vertical orientation. Furthermore, there is a need for a rolled sheet dispensing device that permits convenient and easy securing of the device to a surface through the use of a mounting bracket, and convenient detachment from the mounting bracket to allow location of the device on a horizontal surface and dispensing of the rolled sheet product in any location.

SUMMARY

An aspect of the present application provides for a rolled sheet product dispenser, comprising a base, a shaft oriented coaxially with the base, the shaft having a first end and a second end, the first end being attached to the base, a bracket including at least one mounting surface, and a base engagement element attached to the base, the base engagement element being operable for detachable engagement with the bracket, wherein the bracket is operable to position the shaft horizontally when the base engagement element is engaged with the bracket, and the shaft is dimensioned to allow insertion of the shaft within a roll of a rolled sheet product.

A further aspect of the present application provides for a rolled sheet product dispenser, comprising a base including a first plate and a second plate positioned coaxially and spaced apart to form a cavity therebetween, a shaft oriented coaxially with the base, the shaft having a first end and a second end, the first end being attached to the base, a bracket including at least one mounting surface, a bracket engagement element positioned on the bracket, and a base engagement element located in the cavity, the base engagement element being operable for detachable engagement with the bracket, wherein the bracket is operable to position the shaft horizontally when the base engagement element is engaged with the bracket, and the shaft is dimensioned to allow insertion of the shaft within a roll of a rolled sheet product.

A further aspect of the present application provides for a method for locating a rolled sheet product dispenser, the rolled sheet product dispenser including a shaft attached perpendicularly to a base and at least one base engagement element attached to the base, comprising attaching a bracket to a surface, the bracket including at least one mounting surface and a bracket engagement element positioned on the bracket, orienting the base to the bracket engagement element, and engaging the base engagement element within the bracket engagement element such that the shaft is horizontal.

BRIEF DESCRIPTION OF THE DRAWINGS

Embodiments of the present application are illustrated by way of example in the accompanying figures, in which like reference numbers indicate similar elements, and in which.

DETAILED DESCRIPTION

An exemplary embodiment of a rolled sheet product dispensing device 100 will now be described with reference to FIG. 1.

The rolled sheet product dispensing device 100 may be used to store and dispense sheet products that are packaged by rolling the sheet product around a central hollow core roll. The rolled sheet product may include, for instance, consumer products such as paper towel, paper napkins, cellophane wrap, aluminum foil, wax paper, toilet tissue, drawing paper, and the like.

As will be understood by one skilled in the art, although the description of the present application includes description and illustration of an embodiment of rolled sheet product dispensing device suitable for consumer use, the methods and apparatuses of the present application may be utilized in the storage and dispensing of any product formed in sheets and packaged and stored by rolling the product around a hollow central core roll. For instance, the rolled sheet product may include industrial papers, plastics, metals, and the like, as well as products dispensed for commercial use, such as packaging paper, packaging wrap, screens, fencing, stickers, emblems, and the like. Use of the methods and apparatuses of the present application for products having industrial, commercial, or other use may be performed through modification of one or more dimensions to accommodate such products, without departing from the spirit and scope of the present application. For instance, a shaft having a longer length and/ or larger diameter may be used when storing and dispensing rolled sheet products having a greater weight and/or size than rolled sheet products produced for domestic consumer use.

Figure 1:
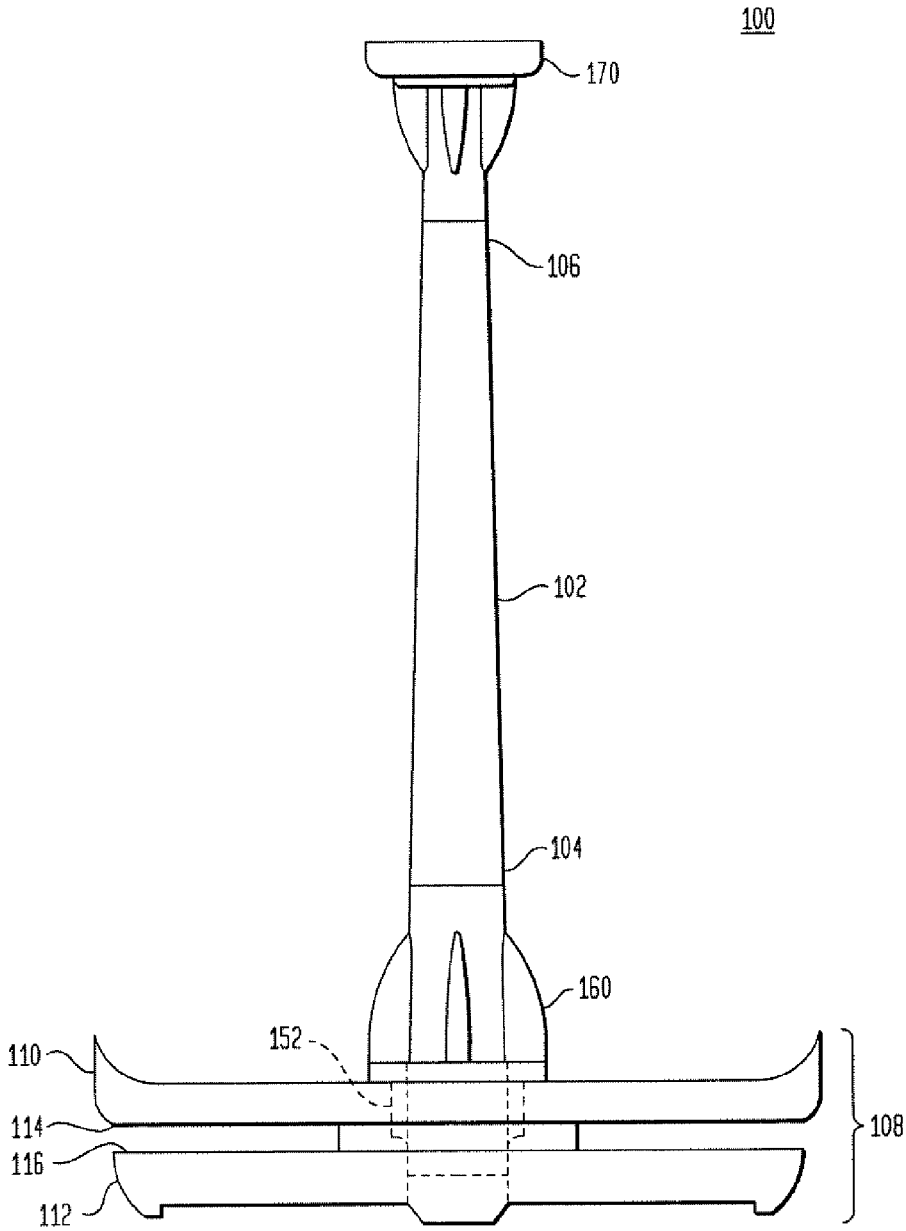
FIG. 1 shows a rolled sheet product dispensing device according to an exemplary embodiment of the application.

Referring to FIG. 1, a shaft 102 having a first end 104 and a second end 106 may be attached to a circular base 108. The shaft 102 may be hollow or solid, and may be constructed of any suitable rigid or semi-rigid material, such as metal, plastic, rubber, wood, composite material, and the like. In an exemplary embodiment, the shaft 102 may be cylindrical. The base 108 may likewise be constructed of any suitable rigid or semi-rigid material, such as metal, plastic, rubber, wood, composite material, and the like. In an exemplary embodiment, the base 108 may be circular and have a diameter corresponding to an approximate diameter of the rolled sheet product.

Alternatively, the shaft 102 may have a cross-section that is oval, polygonal, or any other suitable geometry. Likewise, base 108 may alternatively have a form other than circular, and may for instance be formed in an oval or polygonal shape containing any suitable number of edges. The base 108 may be solid, or may include a plurality of plate elements.

Figure 8:
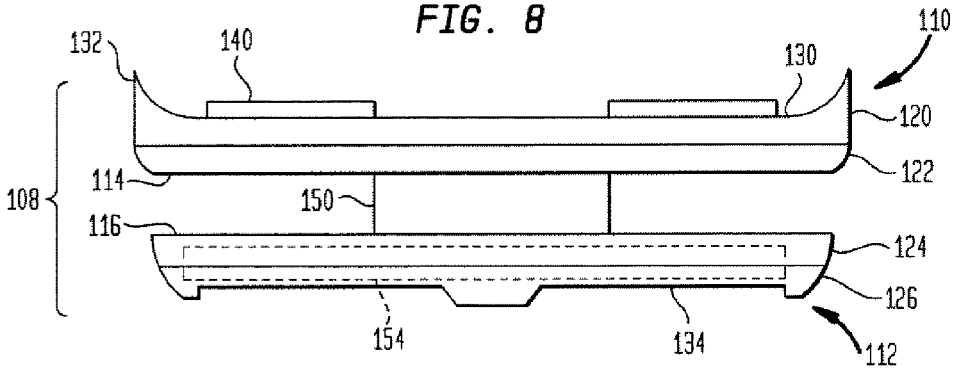
FIG. 8 shows a cross-sectional view of a base according to an exemplary embodiment of the application.

For instance, referring to FIG. 8, in an exemplary embodiment the base 108 may include a plurality of plate elements positioned coaxially and spaced apart so as to form a cavity between the plate elements. A first plate 110 may be positioned coaxially with and spaced apart from a second plate 112, the first plate 110 and the second plate 112 being positioned such that a surface 114 of the first plate 110 is substantially parallel to a surface 116 of the second plate 112.

When the base 108 includes a first plate 110 and a second plate 112, each of the first plate 110 and the second plate 112 may be constructed of a plurality of elements. In an exemplary embodiment, for instance, the first plate 110 may include a first plate upper plate half 120 and a first plate lower plate half 122. The second plate 112 may include a second plate upper half 124 and a second plate lower half 126. The first plate upper half 120 and the first plate lower plate half 122 may be attached to each other by fasteners, adhesive, compression fit, or other suitable mechanism. The second plate upper half 124 and the second plate lower half 126 may be attached to each other by fasteners, adhesive, compression fit, or other suitable mechanism.

An upper exterior surface of the base 130 may include one or more grooves, ridges, lips, channels, and the like, operable to guide and/or position the rolled sheet product. In an exemplary embodiment, for instance, a lip element 132 may be located on the upper surface 130, and the lip element may include a plurality of raised portions or may form a continuous raised portion extending the entire circumference of the base 108. Additionally, a lower exterior surface 134 of the base 108 may include feet, protrusions, grommets, or other similar elements having a high coefficient of friction and operable resist sliding of the dispenser on a horizontal surface.

In an alternative exemplary embodiment, a base friction element 140 may be positioned on and/or affixed to the exterior upper surface 130 of the base or of the first plate 110. The base friction element 140 may be constructed of rubber, plastic, and the like, and may include ridges, dimples, grooves, or other suitable geometrical elements operable to resist rotation of the rolled paper product.

A base engagement element 150 may be positioned between the first plate 110 and the second plate 112. The base engagement element 150 may be a cylinder, having a circular or substantially-circular cross-section. Alternatively, the base engagement element 150 may have an oval cross-section, a polygonal cross-section, such as a square, triangle, or any suitable combination thereof. In an exemplary embodiment, the base engagement element 150 may be positioned substantially coaxially with the base 108. When the base 108 includes a first plate 110 and a second plate 112, the base engagement element 150 may be positioned such that a first end of the base engagement element 150 may be in contact with the first plate 110, while a second end of the base engagement element 150 may be in contact with the second plate 112. The base engagement element 150 may be constructed of any suitable material such as metal, plastic, rubber, wood, composite material, or the like. In an alternative embodiment, the base engagement element 150 may be located above or below the base 108.

In an exemplary embodiment, a base weighting element may be located within the base 108. The base weighting element 154 may be operable to provide stability and weight to the base 108, and act to stabilize the base 108. The base weighting element 154 may be constructed of any suitable material such as metal, plastic, rubber, wood, composite material, or the like.

The shaft 102 may be attached directly to the base 108 or to the first plate 112 and/or second plate 112, for instance by adhesive, fasteners, threads, compression fit, and the like. Alternatively, a bearing 152 may be located between the shaft 102 and the base 108. The bearing 152 may thereby allow rotation of the shaft 102 with respect to the base 108 or with respect to the first plate 110 and/or second plate 112.

At least one flexible securing element 160 may be positioned on the shaft 102. In an exemplary embodiment, the flexible securing element may include at least one flexible fin element 162 operable for contacting with an inner surface of a central hollow core roll of the rolled sheet product.

Figure 9:
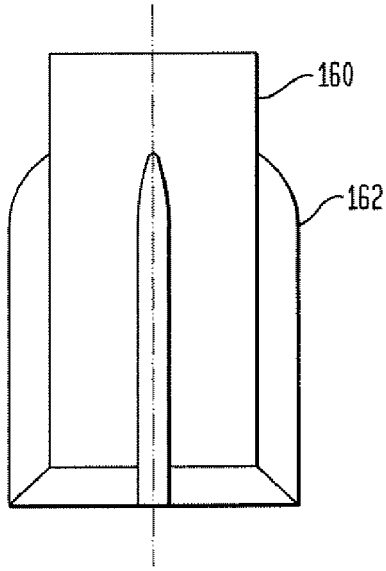
FIG. 9 shows a side view of a flexible securing element according to an exemplary embodiment of the application.
Figure 10:
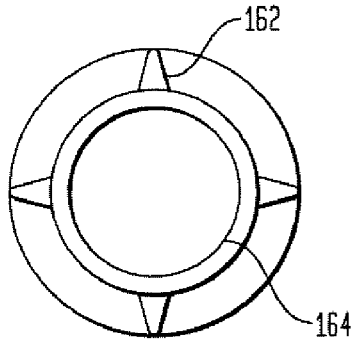
FIG. 10 shows a top view of a flexible securing element according to an exemplary embodiment of the application.

Referring to FIGS. 9 and 10, the flexible securing element 160 may include a central aperture 164, and the central aperture 164 may be dimensioned such that it fits tightly over an exterior surface of the shaft 102. The flexible securing element 160 may rotate with respect to the shaft 102 or may be affixed to the shaft 102, for instance by adhesive, fasteners, compression fit, or other suitable mechanism.

In an exemplary embodiment, two flexible securing elements 160 may be located on the shaft 102, and positioned approximately at the first end 104 and second end 106 of the shaft, to allow secure location of the hollow core roll of the rolled sheet product on the shaft 102.

The at least one flexible securing element 160 may act to resist rotation of the rolled sheet product through friction between the flexible securing element 160 and the inner surface of the central hollow core roll of the rolled sheet product. Alternatively, the at least one flexible securing element 160 may act to resist rotation of the rolled sheet product through friction between the flexible securing element 160 and the shaft 102. Such resistance may serve to retard or restrict the rotation of the rolled sheet product when the sheet product is pulled by a user, for instance during a dispensing operation. In various alternative exemplary embodiments, utilization of flexible securing elements 160 of varying dimensions may allow variation of an amount of frictional force generated, and accordingly of an amount of restriction or retardation of rotation of the rolled sheet product. Such variation may serve to allow convenient dispensing of a preferred quantity of rolled sheet product, for instance of a particular length, a particular number of sheets, and the like.

Figure 11:
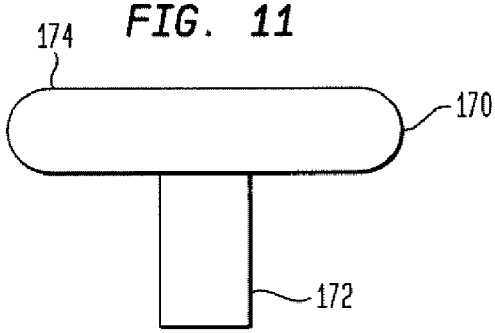
FIG. 11 shows a side view of a roll containment cap according to an exemplary embodiment of the application.

A roll containment cap 170 may be positioned at the second end of the shaft 106. Referring to FIG. 11, the roll containment cap 170 may include a neck portion 172 and a head portion 174, with a diameter of the head portion 174 being larger than a diameter of the neck portion 172. In an exemplary embodiment, the head portion 174 may be substantially circular and plate-shaped, and the neck may be substantially cylindrical and dimensioned to fit within the second end of the shaft 106. The neck may include a single portion or may include plurality of portions, and each of the plurality of neck portions may be of a different diameter, length, and/or width.

In an alternative exemplary embodiment, a grommet may be located within the second end of the shaft 106, for instance by insertion into the second end of the shaft 106 such that the neck of the roll containment cap 170 may be positioned within the hollow grommet. The grommet may be secured within the shaft 102 by adhesives, fasteners, threads, compression fit, or other suitable mechanism. Likewise, The roll containment cap 170 may be secured within the grommet or the shaft 102 by adhesives, fasteners, threads, compression fit, or other suitable mechanism.

In various alternative exemplary embodiments, the head portion 174 of the roll containment cap 170 may have different dimensions and/or geometries. For instance, the head portion may be formed in a substantially square or other polygonal shape, or may be formed in a spherical, oval, or other suitable shape.

Figure 2:
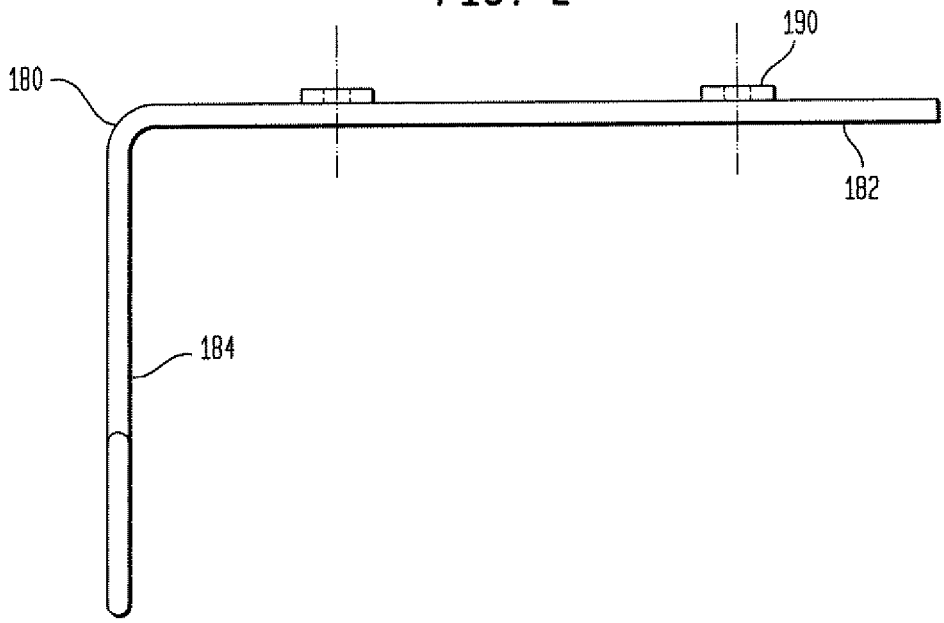
FIG. 2 shows a side view of a bracket according to an exemplary embodiment of the application.
Figure 3:
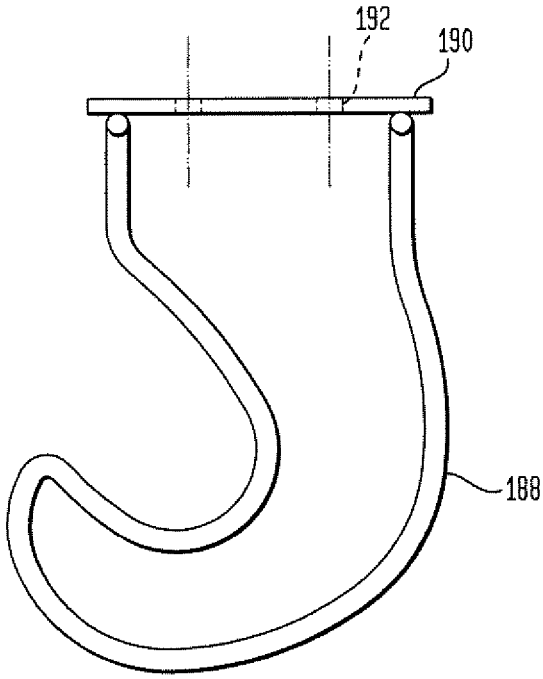
FIG. 3 shows a front view of a bracket according to an exemplary embodiment of the application.

Referring to FIG. 2, a bracket 180 may be provided. The bracket 180 may include mounting surface portion 182 allowing attachment of the bracket 180 to a surface. The surface to which the bracket may be attached may include, for instance, a horizontal surface such as an underside of a shelf, cabinet, and the like. The surface to which the bracket may be attached may also include a vertical wall or another suitable surface at an angle to the horizontal.

In an exemplary embodiment, the bracket 180 may include a bracket engagement element 184 positioned substantially perpendicularly to the mounting surface portion 182. Alternatively, the bracket engagement element 184 may be positioned at any other angle with respect to the mounting surface portion 182, for instance, to allow attachment of the bracket to surfaces of any orientation.

In an exemplary embodiment, the bracket engagement element 184 may be attached to the bracket 180 by a hinge, pivot, clasp, or other suitable mechanism allowing adjustment of an angle between the bracket engagement element 184 and the bracket 180.

In an exemplary embodiment, the bracket engagement element 184 may include a hook portion 188. The hook portion 188 may include an open, arcuate hook portion 188 dimensioned such that the base engagement element 150 may be located within the arcuate length of the hook portion 188. The hook portion 188 may have a thickness allowing insertion of the hook portion 188 within the cavity formed between the first plate 110 and the second plate 112.

In alternative exemplary embodiments, the hook portion 188 of the bracket engagement element 184 may be formed in other geometries. For instance, when the base engagement element 150 is formed having a cross-section that is not circular, the hook portion 188 may have a correspondingly-shaped geometry operable to allow insertion and close fit of the base engagement element 150 into the hook portion 188.

In an exemplary embodiment, the bracket may be formed of a single length of rigid wire, bent to form a mounting surface portion 182 and a substantially perpendicular bracket engagement portion 184. Alternatively, the bracket may be formed of one or more sections of metal, sheet metal, plastic or other suitable polymer, wood, composite material, or any other suitable material.

The bracket 180 may include one or more mounting plates 190. Each mounting plate may be attached to the bracket, and may include at least one mounting hole 192 operable for attachment of the bracket 180 to a horizontal surface, for instance by inserting screws, bolts, or other fasteners through the at least one mounting hole.

As will be understood by one skilled in the art, numerous other attachment mechanisms may be utilized to attach the bracket to a surface, with or without the use of mounting holes, such as welding, compression fitting, or through use of adhesive, hook-and-loop fasteners, clamps, and the like.

Figure 4:
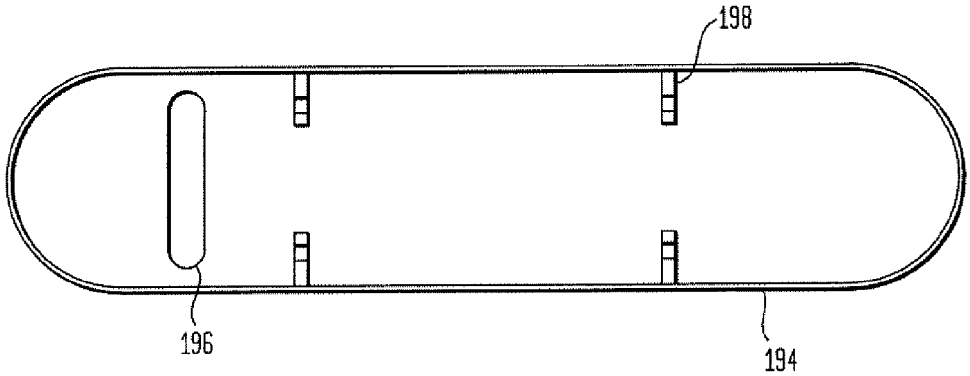
FIG. 4 shows a bottom side of a bracket cover according to an exemplary embodiment of the application.
Figure 5:
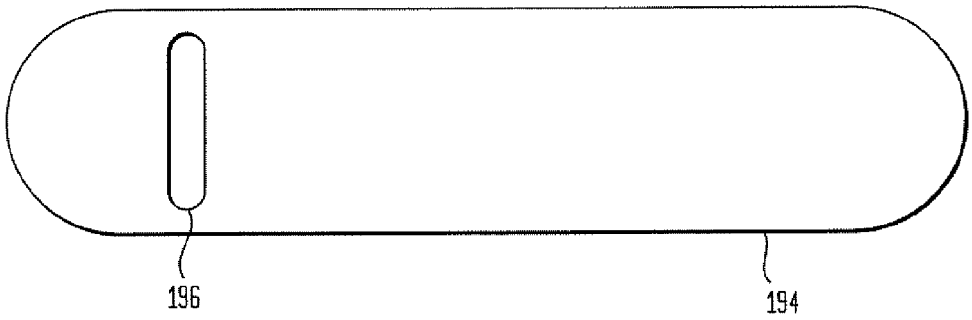
FIG. 5 shows a top side of a bracket cover according to an exemplary embodiment of the application.
Figure 6:
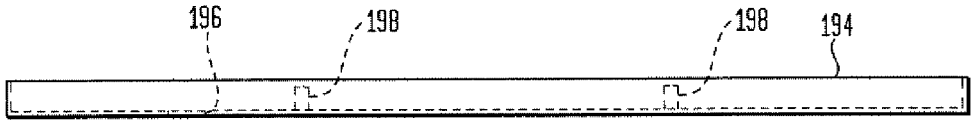
FIG. 6 shows a side of a bracket cover according to an exemplary embodiment of the application.

Referring to FIGS. 4-6, a bracket cover 194 may be provided on the bracket 180 to cover at least part of the bracket and/or bracket mounting plates 190. The bracket cover 194 may include an aperture 196 which may be positioned over the bracket engagement portion 184. The bracket cover 194 may additionally include at least one bracket clip 198 for securing the bracket cover element 194 to the bracket 180. Alternatively, the bracket cover 194 may lack an aperture 196, and may be formed in other geometries corresponding to bracket geometries as described above with respect to alternative exemplary embodiments.

Figure 7:
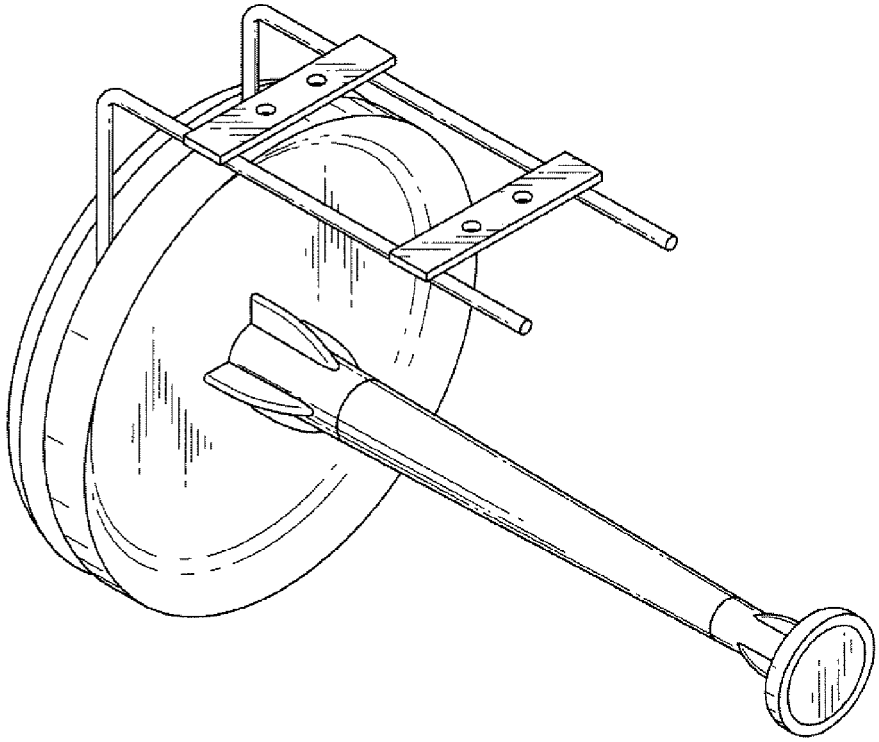
FIG. 7 shows a perspective view of a rolled sheet product dispensing device according to an exemplary embodiment of the application.

Accordingly, in an exemplary embodiment, the bracket 180 may be attached to a surface, for instance a horizontal surface such as the underside of a shelf, cabinet, and the like. When the bracket 180 is attached to such a horizontal surface, the bracket engagement element 184 may therefore extend away from the horizontal surface. The base 108 may be oriented such that the cavity formed between the first plate 110 and the second plate 112 is aligned with the bracket engagement portion 184, and the base 108 may be positioned to engage the base engagement element 150 and the bracket engagement element 184 by inserting the base engagement element 150 within the hook portion 188 of the bracket engagement element 184. Upon such engagement, the bracket engagement element 184 may abut the surfaces of the cavity, thereby locating the dispenser such that the shaft 102 is positioned in a horizontal orientation, as seen in FIG. 7. Displacement of the base 108 and attached elements may therefore be restricted by contact between the bracket engagement element 184 and the surfaces of the base 108, for instance, surfaces of the cavity formed between the first plate 110 and the second plate 112. Such an engagement of the bracket engagement element 184 and the base engagement element 150 may therefore allow convenient dispensing of rolled sheet product positioned on the shaft 102 in a horizontal dispenser orientation.

In an exemplary embodiment, after engagement of the base engagement element 150 and the bracket engagement element 184, the base 108 and/or the shaft 102 attached to the base 108 may therefore rotate freely about the axis of the base 108 and/or shaft 102.

The dispenser 100 may be disengaged from the bracket 180 by lifting the dispenser 100 upwards to remove the base engagement element 150 from the hook portion 188 of the bracket engagement element 184. The dispenser may thereafter be positioned with the base 108 in contact with a horizontal surface, such as a table, countertop, and the like, allowing convenient location of the dispenser 100 and dispensing of rolled sheet product positioned on the shaft 102 in a vertical orientation.

As described above, in various exemplary embodiments, the base engagement element 150 may be cylindrical, or may have a non-circular cross-section, including oval, polygonal, square, rectangle, triangle, or any suitable combination thereof. Additionally, in various exemplary embodiments, the base engagement element 150 may be constructed of any suitable material such as metal, plastic, rubber, wood, composite material, or the like. When the base engagement element 150 is constructed of a suitable material having elasticity, surface roughness, surface tackiness, and the like, the base engagement element 150 may accordingly generate friction between the base engagement element 150 and the bracket engagement element 184, such that rotation of the base 108 and attached elements is restricted and/or retarded when the rolled sheet product is dispensed, for instance through pulling on the rolled sheet product.

A quantity of friction generated, and a corresponding resistance to rotation of the base 108 and attached elements, may be varied by modifying the diameter of the base engagement element 150 and/or the dimensions of the bracket engagement element 184, such that a fit between the base engagement element 150 and the bracket engagement element 184 is tighter or looser.

In an exemplary embodiment, the base engagement element 150 and/or the bracket engagement element 184 may be dimensioned such that the base 108 and attached elements may not rotate. Alternatively, the base engagement element 150 and/or the bracket engagement element 184 may be dimensioned such that the base 108 and attached elements may rotate only under the application of a large quantity of rotational force.

In alternative exemplary embodiments, as described above, the base engagement element 150 may have a non-circular cross-section, and the bracket engagement element 184 may include a non-arcuate hook portion 188 corresponding to the geometry of the base engagement element 150. The non-arcuate hook portion 188 geometry may include, for example, oval, polygonal, square, rectangle, triangle, or any suitable combination thereof. Accordingly, the geometries of the base engagement element 150 and the bracket engagement element 184 may operate to prevent rotation of the base 108 and attached elements completely when the base engagement element 150 is engaged with the bracket engagement element 184.

Figure 12:
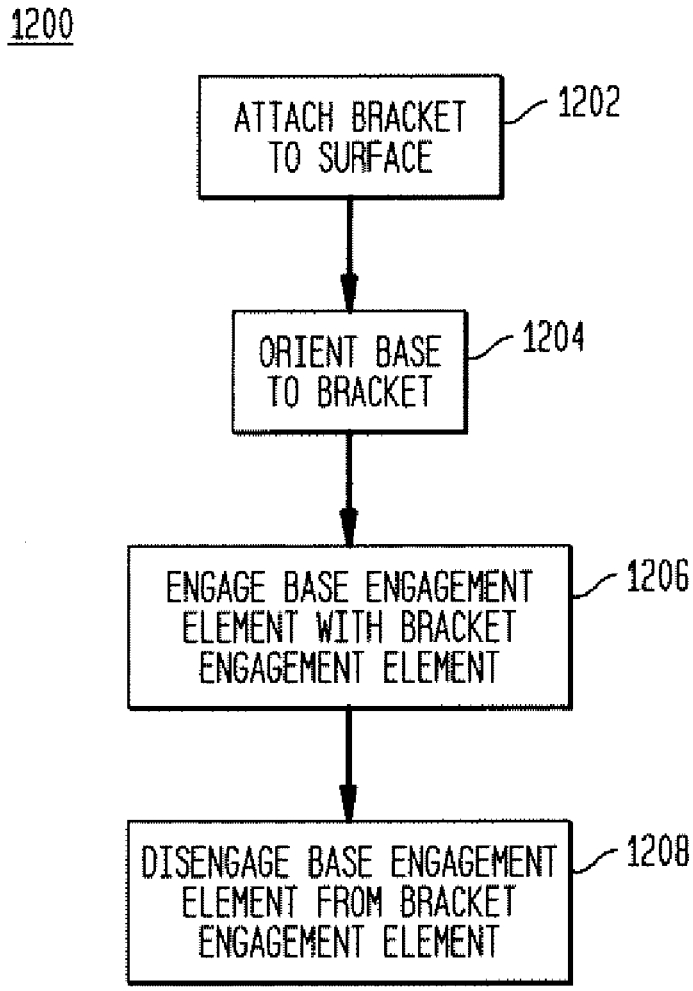
FIG. 12 is a flow diagram of a method for locating a rolled sheet product dispenser according to an exemplary embodiment of the application.

A method for locating a rolled sheet product dispenser is now described with reference to the process 1200 as shown in FIG. 12. At step 1202, the bracket 180 may be attached to a surface, as described above. The base 106 may be oriented to the bracket 180, for instance with respect to the bracket engagement element 184, at step 1204. The base engagement element 150 may then be engaged with the bracket engagement element 184 at step 1206, to locate the rolled sheet product dispenser. The base engagement element 150 may be disengaged from the bracket engagement element 184 at step 1208.

As will be understood by one skilled in the art, the present application is not limited to the precise exemplary embodiments described herein and various changes and modifications may be effected without departing from the spirit or scope of the application. For example, elements and/or features of different illustrative embodiments may be combined with each other, substituted for each other, and/or expanded upon within the scope of the present disclosure and the appended claims. In addition, improvements and modifications which become apparent to persons of ordinary skill in the art after reading the present disclosure and appended drawings are deemed within the spirit and scope of the present application.

What is claimed is:

1. A rolled sheet product dispenser, comprising:

a base;

a shaft oriented coaxially with the base, the shaft having a first end and a second end, the first end being attached to the base;

a bracket including at least one mounting surface; and a base engagement element attached to the base, the base engagement element being operable for detachable engagement with the bracket, wherein the bracket is operable to position the shaft horizontally when the base engagement element is engaged with the bracket;

the shaft is dimensioned to allow insertion of the shaft within a roll of a rolled sheet product;

the base comprises a first late and a second plate, the first plate and the second plate being positioned coaxially and spaced apart to form a cavity therebetween;

the base engagement element is located in the cavity, the base engagement element including a cylindrical base engagement element, the cylindrical base engagement element having a diameter smaller than a diameter of the first plate and the second plate and being oriented coaxially with the first plate and the second plate; and the bracket engagement element includes a hook element, the hook element being operable for positioning within the cavity and around the cylindrical base engagement element.

2. The rolled sheet product dispenser of claim 1, further comprising a bracket engagement element positioned on the bracket.

3. The rolled sheet product dispenser of claim 2, wherein the bracket engagement element is oriented perpendicularly to the at least one mounting surface.

4. The rolled sheet product dispenser of claim 1, wherein at least one of the first plate and the second plate includes a base hole; and the shaft is inserted within the base hole.

5. The rolled sheet product dispenser of claim 4, wherein the shaft is attached to the base through a compression fit between an outside surface of the shaft and an inside surface of the base hole.

6. The rolled sheet product dispenser of claim 1, wherein the base is operable for placement on a horizontal surface when the base engagement element is not engaged with the bracket; and the shaft is perpendicular to the horizontal surface when the base is placed on the horizontal surface.

7. The rolled sheet product dispenser of claim 1, further comprising a roll containment cap having a neck and a head, wherein an outside diameter of the head is larger than an outside diameter of the neck; and the neck is operable for insertion into the second end of the shaft.

8. The rolled sheet product dispenser of claim 1, further comprising at least one flexible securing element positioned on the shaft, the at least one flexible securing element including:

a plurality of flexible fins dimensioned to contact an inner surface of the roll of the rolled sheet product; and an aperture having an inside surface contacting an outside surface of the shaft.

9. The rolled sheet product dispenser of claim 1, further comprising a bearing element positioned between the shaft and the base, wherein the bearing element is operable for rotation with respect to at least one of the shaft or the base and is operable to permit rotation of the shaft with respect to the base.

10. The rolled sheet product dispenser of claim 9, wherein the at least one mounting plate is positioned in parallel with the at least one mounting surface.

11. The rolled sheet product dispenser of claim 1, further comprising:

at least one mounting plate attached to the bracket and positioned in parallel with the at least one mounting surface;

at least one mounting hole positioned in the at least one mounting plate, the at least one mounting hole operable for attaching the bracket to a surface.

12. The rolled sheet product dispenser of claim 1, further comprising a thin base weighting element one of positioned within the base or attached to the base.

13. The rolled sheet product dispenser of claim 1, wherein the bracket is formed of a single length of metal wire.

14. The rolled sheet product dispenser of claim 1, further comprising a base friction element located on an upper surface of the base.

15. The rolled sheet product dispenser of claim 1, further comprising a bracket cover including at least one aperture, wherein the bracket cover is operable for attaching to the bracket; and the at least one bracket mounting surface is covered by the bracket cover when the bracket cover is attached to the bracket.

16. A rolled sheet product dispenser, comprising:

a base including a first plate and a second plate positioned coaxially and spaced apart to form a cavity therebetween;

a shaft oriented coaxially with the base, the shaft having a first end and a second end, the first end being attached to the base;

a bracket including at least one mounting surface;

a bracket engagement element positioned on the bracket; and a base engagement element located in the cavity, the base engagement element being operable for detachable engagement with the bracket, wherein the bracket is operable to position the shaft horizontally when the base engagement element is engaged with the bracket;

the shaft is dimensioned to allow insertion of the shaft within a roll of a rolled sheet product;

the base comprises a first plate and a second plate, the first plate and the second plate being positioned coaxially and spaced a art to form a cavity therebetween;

the base engagement element is located in the cavity, the base engagement element including a cylindrical base engagement element, the cylindrical base engagement element having a diameter smaller than a diameter of the first plate and the second plate and being oriented coaxially with the first plate and the second plate; and the bracket engagement element includes a hook element, the hook element being operable for positioning within the cavity and around the cylindrical base engagement element.

17. A method for locating a rolled sheet product dispenser, the rolled sheet product dispenser including a shaft attached perpendicularly to a base and at least one base engagement element attached to the base, comprising:

attaching a bracket to a surface, the bracket including at least one mounting surface and a bracket engagement element positioned on the bracket;

orienting the base to the bracket engagement element; and engaging the base engagement element within the bracket engagement element such that the shaft is horizontal, wherein the base comprises a first plate and a second plate, the first plate and the second plate being positioned coaxially and spaced apart to form a cavity therebetween;

the base engagement element is located in the cavity, the base engagement element including a cylindrical base engagement element, the cylindrical base engagement element having a diameter smaller than a diameter of the first plate and the second plate and being oriented coaxially with the first plate and the second plate; and the bracket engagement element includes a hook element, the hook element being operable for positioning within the cavity and around the cylindrical base engagement element.

18. A rolled sheet product dispenser, comprising:

a base;

a shaft oriented coaxially with the base, the shaft having a first end and a second end, the first end being attached to the base;

a bracket including at least one mounting surface; and a base engagement element attached to the base, the base engagement element being operable for detachable engagement with the bracket, wherein the bracket is operable to position the shaft horizontally when the base engagement element is engaged with the bracket;

the shaft is dimensioned to allow insertion of the shaft within a roll of a rolled sheet product;

the base comprises a first plate and a second plate;

the first plate and the second plate are positioned coaxially and spaced apart to form a cavity therebetween;

the base engagement element is located in the cavity;

at least one of the first plate and the second plate includes a base hole; and the shaft is inserted within the base hole.

19. A rolled sheet product dispenser, comprising:

a base;

a shaft oriented coaxially with the base, the shaft having a first end and a second end, the first end being attached to the base;

a bracket including at least one mounting surface; and a base engagement element attached to the base, the base engagement element being operable for detachable engagement with the bracket, wherein the bracket is operable to position the shaft horizontally when the base engagement element is engaged with the bracket;

the shaft is dimensioned to allow insertion of the shaft within a roll of a rolled sheet product;

the base comprises a first plate and a second plate;

the first plate and the second late are positioned coaxially and spaced apart to form a cavity therebetween;

the base engagement element is located in the cavity;

at least one of the first plate and the second plate includes a base hole;

the shaft is inserted within the base hole; and the shaft is attached to the base through a compression fit between an outside surface of the shaft and an inside surface of the base hole.

20. A rolled sheet product dispenser, comprising:

a base;

a shaft oriented coaxially with the base, the shaft having a first end and a second end, the first end being attached to the base;

a bracket including at least one mounting surface; and a base engagement element attached to the base, the base engagement element being operable for detachable engagement with the bracket; and at least one flexible securing element positioned on the shaft, the at least one flexible securing element including a plurality of flexible fins dimensioned to contact an inner surface of the roll of the rolled sheet product, and an aperture having an inside surface contacting an outside surface of the shaft, wherein the bracket is operable to position the shaft horizontally when the base engagement element is engaged with the bracket, and the shaft is dimensioned to allow insertion of the shaft within a roll of a rolled sheet product.

21. A rolled sheet product dispenser, comprising:

a base;

a shaft oriented coaxially with the base, the shaft having a first end and a second end, the first end being attached to the base;

a bracket including at least one mounting surface; and a base engagement element attached to the base, the base engagement element being operable for detachable engagement with the bracket, wherein the bracket is operable to position the shaft horizontally when the base engagement element is engaged with the bracket, the bracket is formed of a single length of metal wire, and the shaft is dimensioned to allow insertion of the shaft within a roll of a rolled sheet product.

22. A rolled sheet product dispenser, comprising:

a base;

a shaft oriented coaxially with the base, the shaft having a first end and a second end, the first end being attached to the base;

a bracket including at least one mounting surface;

a base engagement element attached to the base, the base engagement element being operable for detachable engagement with the bracket; and a bracket cover including at least one aperture, wherein the bracket is operable to position the shaft horizontally when the base engagement element is engaged with the bracket;

the shaft is dimensioned to allow insertion of the shaft within a roll of a rolled sheet product;

the bracket cover is operable for attaching to the bracket; and the at least one bracket mounting surface is covered by the bracket cover when the bracket cover is attached to the bracket.

* * * * *